US008261518B2

(12) United States Patent
Stemmle

(10) Patent No.: US 8,261,518 B2
(45) Date of Patent: Sep. 11, 2012

(54) IN-LINE DEFORMATION BINDING APPARATUS

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 1673 days.

(21) Appl. No.: 11/187,384

(22) Filed: Jul. 22, 2005

(65) Prior Publication Data

US 2007/0017188 A1 Jan. 25, 2007

(51) Int. Cl.
*B65B 43/00* (2006.01)

(52) U.S. Cl. ..... 53/569; 53/206; 53/547; 53/550

(58) Field of Classification Search ..... 53/135.3, 53/206, 550, 569, 547; 493/394, 153, 216, 493/296, 917
See application file for complete search history.

(56) References Cited

U.S. PATENT DOCUMENTS 1,954,965 A * 4/1934 Thode ..... 493/390
2,103,390 A * 12/1937 Salfisberg ..... 53/154
2,420,983 A * 5/1947 Salfisberg ..... 53/436
2,580,456 A * 1/1952 Noe ..... 53/545
4,589,145 A * 5/1986 Van Erden et al. ..... 383/5
4,631,905 A * 12/1986 Maloney ..... 53/554
5,442,897 A * 8/1995 Hinzmann et al. ..... 53/449
5,548,946 A * 8/1996 Holub ..... 53/550
7,114,307 B2 * 10/2006 Tada et al. ..... 53/141
2003/0234282 A1 * 12/2003 Stemmle ..... 229/68.1
2004/0114161 A1 * 6/2004 Stemmle ..... 358/1.9
2006/0026930 A1 * 2/2006 Grishchenko et al. ..... 53/567
2006/0190125 A1 * 8/2006 Stemmle ..... 700/223

* cited by examiner

*Primary Examiner* — Thanh Truong
(74) *Attorney, Agent, or Firm* — Brian A. Collins; Charles R. Malandra, Jr.; Steven J. Shapiro

(57) ABSTRACT

A deformation binding apparatus for fabricating a package defining a content area therein such as a mailpiece. The deformation binding apparatus including axial and radial binding mechanisms for deformation binding sheet material along first and second bind lines, respectively. The axial and radial binding mechanisms are in-line such that the sheet material may be passed along a unidirectional path to form the mailpiece. Furthermore, the bind lines are orthogonal to enclose at least a portion of the mailpiece. The axial binding mechanism includes first and second rotating elements each having a substantially axial array of intermeshing teeth and a drive device for driving at least one of the rotating elements. The radial binding mechanism includes first and second rotating discs each having a plurality of teeth disposed about the circumference of each and a drive device for driving at least one of the rotating discs.

12 Claims, 7 Drawing Sheets

IN-LINE DEFORMATION BINDING APPARATUS

RELATED APPLICATION

This invention is related to co-pending, commonly owned U.S. patent application Ser. No. 11/187,462 entitled "Multi-sheet In-Line Deformation Binding Apparatus".

TECHNICAL FIELD

This invention relates to a method for fabricating a package such as a mailpiece, and more particularly, to a new and useful in-line deformation binding apparatus for rapid and repeatable package creation.

BACKGROUND OF THE INVENTION

In the context of mailpiece delivery, a self-mailer is a term used for identifying mailpieces which employ some portion of its content information or material to form a finished mailpiece, i.e., a mailpiece ready for delivery. In addition to certain efficiencies gained from the dual use of paper stock, i.e., as both envelope and content material, self-mailers mitigate the potential for disassociation of content material from the mailing envelope, i.e., preventing mail from being delivered to an incorrect address.

In the simplest form, a self-mailer may include a single sheet of paper having printed communications or text on one side thereof and a mailing address on the other. The sheet is then folded and sealed to conceal the printed communications while causing the mailing address to remain visible. Postage evidence may then be applied to the face of the mailpiece in preparation for delivery or prepaid postage indicia may be printed along with the initial printing of address content. This example simply shows that a self-mailer generally seeks to make dual use of the content material to both convey information while forming an envelope of a size and shape which is accepted by postal automation equipment. As such, the material and labor cost associated with combining content material with a container or envelope is minimized.

One such self-mailer includes flat mailpieces which are knurled along each edge of a four-sided rectangular mailpiece. These "flats", as they are frequently called, employ face sheets of paper stock which are oversized relative to the internal content material/sheets such that the peripheral edges thereof extend beyond the edges of the internal sheets on all four sides. The peripheral edges are then deformation bound along the entire length to capture and enclose the content material. Such deformation binding is a process wherein, following plastic deformation of the sheets, the elastic properties thereof develop mechanical forces at or along the interface, which forces are sufficient to bind the sheets together. Alternatively, or additionally, deformation binding may also be viewed as a process wherein the individual fibers of paper stock, upon the application of sufficient pressure/force, interleave or "hook" to form a mechanical interlock. As such, the content material and face sheets may be produced at a single workstation, stacked together and bound without the need for other handling processes i.e., such as folding of the content material or insertion of the content material into an envelope. Furthermore, and, perhaps more importantly, a self-mailer eliminates the requirement for consumable materials such as glue, staples or clips to form the enclosure or bind the edges.

Notwithstanding the potential benefits achievable by deformation binding, drawbacks principally to the binding efficiency or speed offer some explanation for its lack of widespread acceptance and use. For example, and referring to FIG. 1, the knurling wheels 100 of the prior art bind each pair of parallel edges 102*a*, 102*b* of a rectangular mailpiece 104 in a two step binding operation. More specifically, in a first operation, pairs of knurling wheels 100*a* deformation bind the edges 102*a* of the mailpiece 104 as the mailpiece travels in a first direction, indicated by arrow 106. In a second operation, pairs of knurling wheels 100*b* deformation bind the orthogonal edges 102*b* of the mailpiece 104 as the mailpiece travels in a second direction, indicated by arrow 108. The mailpiece 104 must come to a stop between each of the two binding operations and change direction, i.e., the second direction 108 is orthogonal relative to the first direction 106.

While the two step binding sequence described above may be suitable for fabricating mailpieces in small quantities, this manufacturing approach is less acceptable for fabricating large quantities of mailpieces. That is, the orthogonal redirection of the mailpiece slows fabrication sufficiently to render the process inappropriate for high-volume, high speed mailpiece fabrication.

Additionally, and referring to FIG. 2*a*, the knurling wheels of the prior art produce a knurl pattern KP which tends to weaken the corners 110 of the bound mailpiece 104. That is, inasmuch as the knurling wheels deformation bind the mailpiece edges 102*a*, 102*b* along the entire edge, each linear pass causes an overlap in the corners thereby weakening the mailpiece 104, i.e., reducing its structural integrity, at the corners 110 thereof. While the binding operation could be controlled to avoid binding redundancy in the corner regions, i.e., by controlling the gap between each pair of knurling wheels at appropriate points along the linear travel, such control motion would require additional mechanical complexity and further reduce the speed of operation. With respect to the latter, it will be appreciated that the speed and complexity of operation will be adversely impacted by any non-continuous motion of the knurling wheels or transport deck.

Finally, some types of self-mailers use consumable materials, such as prefabricated paper stock or specialty forms. That is, such mailers oftentimes must be pre-prepared with unique glue areas, window cutouts or perforation lines to facilitate mailpiece fabrication. As a result, their unique design does not facilitate or accommodate the use of conventional paper stock, i.e., common size and paper thickness/consistency. Consequently, while certain mailpiece fabrication costs are reduced, i.e., other costs, such as the prefabricated paper stock, are greatly increased.

A need, therefore, exists for an efficient, high speed apparatus for fabricating packages which minimizes mechanical complexities, eliminates the use of consumable materials, and facilitates fabrication using standard office paper stock.

SUMMARY OF THE INVENTION

A deformation binding apparatus is provided for fabricating a package having a content area including axial and radial binding mechanisms for deformation binding sheet material along first and second bind lines. The axial and radial binding mechanisms are in-line such that the sheet material may be passed along a linear feed path to form the package. Furthermore, the bind lines are orthogonal to enclose at least a portion of the package. The axial binding mechanism includes first and second rotating elements having a substantially axial array of intermeshing teeth and a drive device for driving at least one of the rotating elements. The radial binding mechanism includes first and second rotating discs each having a plurality of teeth disposed about the circumference of the first and second rotating discs. The teeth are disposed in intermeshing engagement to form the second bind line of the package of each and a drive device for driving at least one of the rotating discs.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION

The present invention describes an in-line system for fabricating mailpieces having content material sandwiched between sheets of paper stock. In one embodiment of the invention, the content material is contained within a pocket formed by deformation binding the sheet material along orthogonal edges. In another embodiment, content material is combined with a single external sheet which has been folded and deformation bound along orthogonal bind lines. Generally, the mailpieces described may be viewed as "self-mailers" inasmuch as face sheets may include content material, or may be stacked in combination with the content material, to form a finished mailpiece. While the present invention is described in the context of fabricating such mailpieces, it should be appreciated that the teachings of the invention are applicable to the fabrication of any mailpiece wherein deformation binding is a viable or acceptable method for enclosing the mailpiece.

Figure 3:
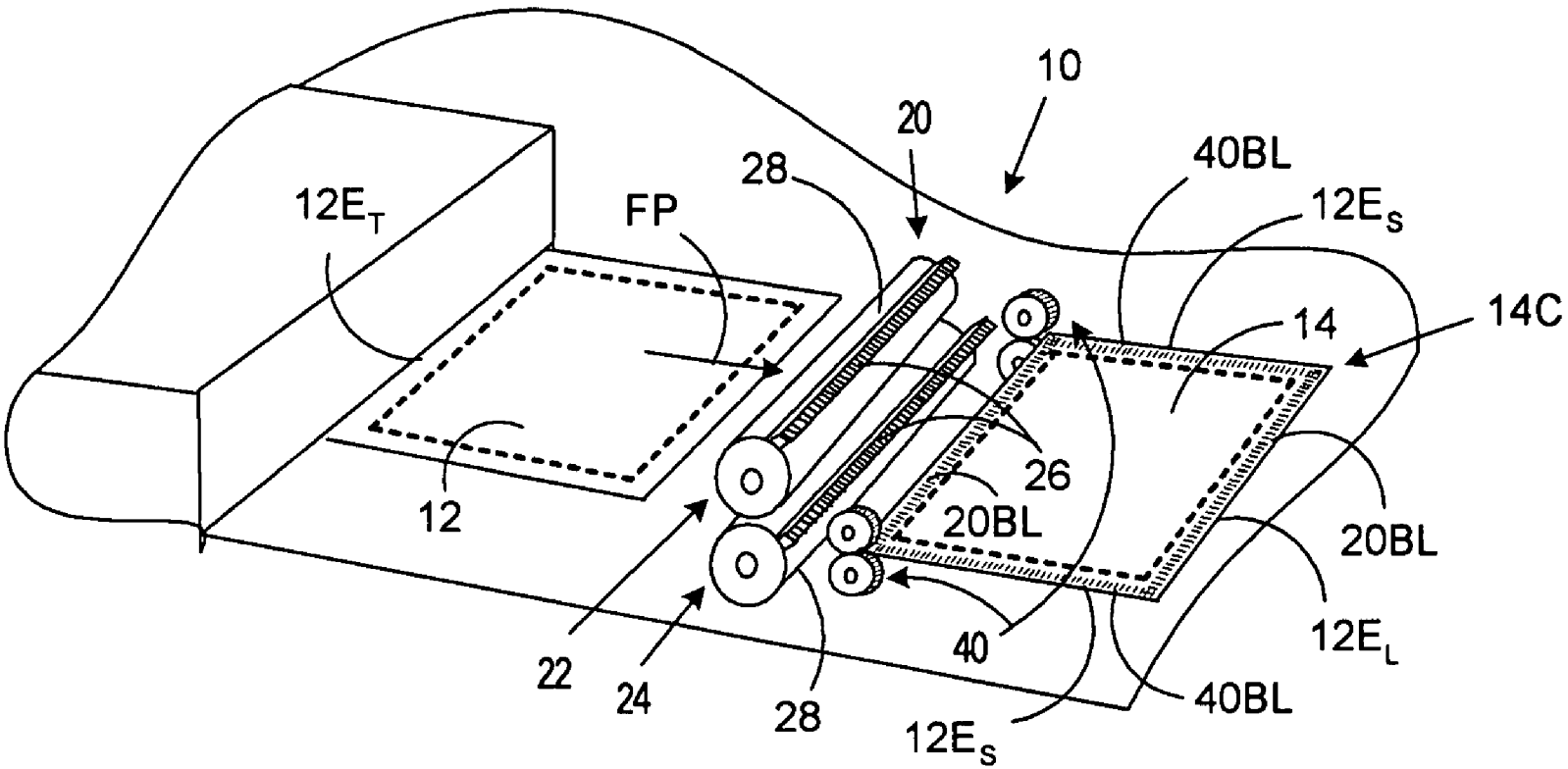
FIG. 3 is a schematic illustration of the relevant components of an in-line deformation binding system according to the teachings of the present invention.
Figure 4:
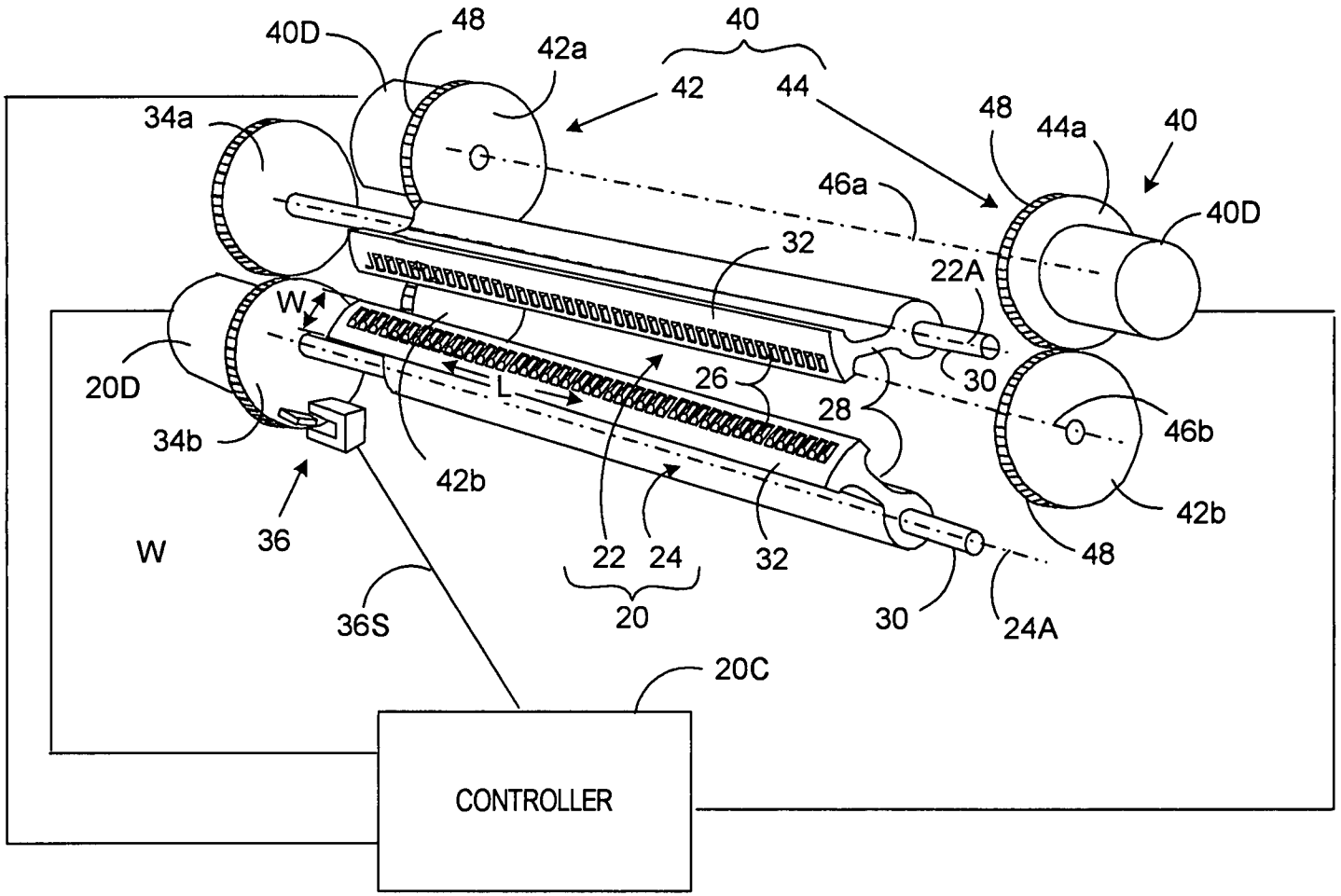
FIG. 4 is a schematic perspective illustration of an axial and radial deformation binding mechanism employed in the deformation binding apparatus of the present invention.
Figure 5A:
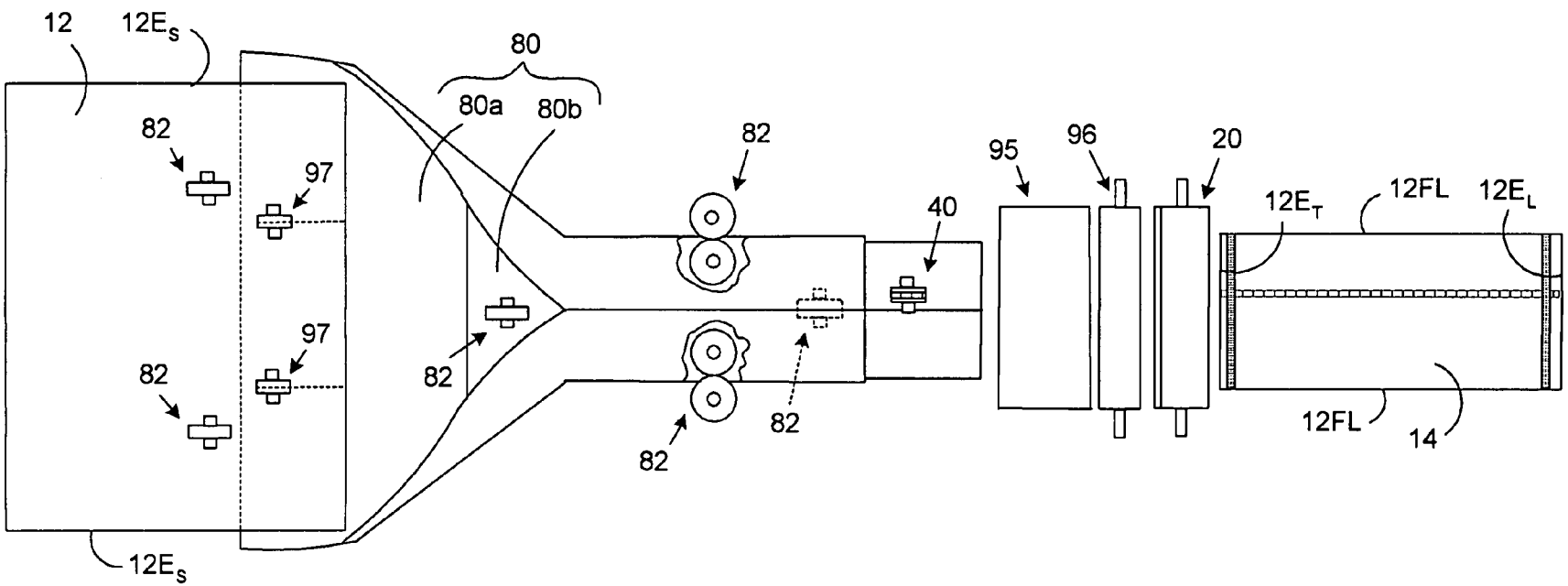
FIGS. 5*a* and 5*b* are plan and profile views, respectively, of an alternate embodiment of the in-line deformation binding apparatus including a curved transport baffle for overlapping opposing edges of the sheet material, a radial binding mechanism adapted to deformation bind the tubular sheet material along the longitudinal seam and an axial binding mechanism adapted to deformation bind the tubular sheet material along the orthogonal ends thereof.
Figure 5B:
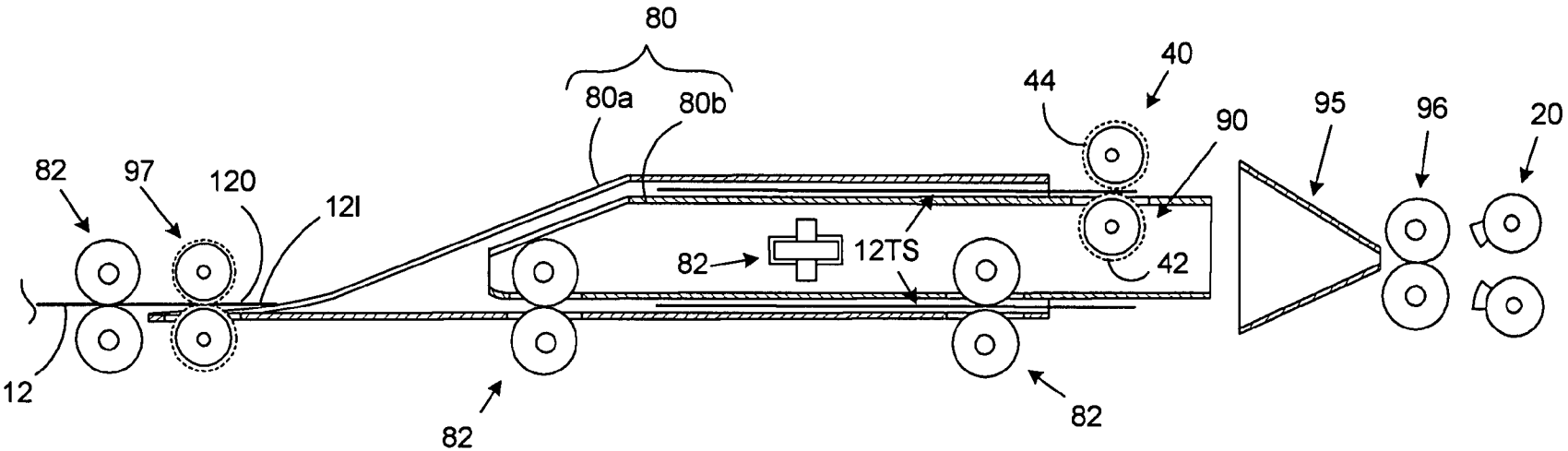

Referring now to FIGS. 3 and 4, an in-line deformation binding apparatus 10 comprises axial and radial binding mechanisms 20, 40 through which sheeted material 12 is passed to fabricate a mailpiece 14. The binding mechanisms 20, 40 are juxtaposed such that the sheet material 12 passes from one to the other of the binding mechanisms 20, 40 along a linear feed path FP (shown in FIG. 3) or single line of travel. Moreover, the binding mechanisms 20, 40 perform at least two binding operations which produce orthogonal bind lines. That is, one or more bind lines 20BL, 40BL are respectively formed by each of the binding mechanisms 20, 40. The cooperation of each of the binding mechanisms 20, 40 together with a discussion of the detailed structural elements is provided in the subsequent paragraphs.

For the purposes of discussing the structural details of the binding mechanisms 20, 40, it will be presumed that the sheeted material 12 has been stacked, arranged and aligned in register in a condition suitable for acceptance by the in-line deformation binding apparatus 10. In the described embodiment, a flat mailpiece 14 is produced, although the teachings of the present invention are useful for producing any mailpiece wherein it is desired to deformation bind the edges or portions thereof to enclose or capture content material. The sheet material 12 for producing the flat mailpiece 14 is rectangular in shape (i.e., a shape which is most compatible for use with automated postal equipment) and has oversized upper and lower face sheets which may extend beyond the internal content material. As such, the extended edges are contiguous and are deformation bound to each other without binding internal content material. As discussed in the Background of the Invention, deformation binding is a familiar process wherein sheet stock is plastically deformed such that mechanical forces are developed along the interface to bind the sheets together. Such mechanical forces are believed to cause the individual fibers of paper stock to interlock, similar to hook and loop fasteners.

FIG. 4 shows an isolated perspective view of the relevant components of the axial and radial binding mechanisms 20, 40. The axial binding mechanism 20 includes a pair of rotating elements 22, 24 defining rotational axes 22A and 24A, respectively. and an axial array of opposed intermeshing teeth 26. More specifically, each of the rotating elements 22, 24 comprises an elongate radial support member 28 mounted upon and driven by a central shaft 30. The elongate radial member 28 has a substantially I-shaped cross-sectional configuration for structurally supporting the axial array of teeth 26 upon a top land portion 32 thereof.

The array of teeth 26 are substantially parallel to the respective rotational axes 22A, 24A, and rotationally indexed such that the teeth 26 intermesh at a predefined angular position of the radial support member 28. In the context used herein, "substantially" parallel, means that the array of teeth define a line which is within about ±5 degrees relative to the respective rotational axis 22A, 24A.

In the described embodiment, the rotating elements 22, 24 rotate through one or more complete revolutions, though the teeth 26 are operable to deformation bind through a relatively small angle thereof. That is, to deformation bind an edge of a mailpiece, the intermeshing teeth 26 may traverse a small arc, e.g., fifteen to twenty degrees (15-20 degrees), however, inasmuch as many applications will require deformation binding along at least two edges, e.g., leading and trailing edges, the rotating elements may rotate through two full revolutions per mailpiece. Generally, one full revolution will be required to deformation bind one edge of a mailpiece, and position the intermeshing teeth, i.e., to a "ready" position, to deformation bind a second edge of the same mailpiece. The rotation requirements and indexing aspects of the invention will be discussed in greater detail hereinafter when describing the function and operation of the in-line deformation binding apparatus 10.

The rotating elements 22, 24 are spatially positioned to effect intermeshing engagement of the teeth 26, while leaving a small radial gap to enable the proper deformation or compaction forces to develop between the bound sheets 12. Generally, it will be desirable to develop uniform compaction forces, i.e., constant pressure, along the length of tooth engagement. While such uniform compaction forces may be attained by precision machining (i.e., by avoiding manufacturing deviations of sufficient magnitude to cause large pressure differences), other corrective measures which take into consideration the strength and/or properties of the materials can be employed. For example, depending upon the component inertia, modulus and/or stiffness of materials, it may be desirable to compensate for the anticipated flexure (i.e., under the compaction load) by outwardly "bowing" the center radial support member. Alternatively, the teeth 26 may be crowned to uniformly distribute the load. Notwithstanding, countermeasures which may be employed via machining, it may be desirable to incorporate an incremental adjustment mechanism (not shown) between the shafts 30 to increase or decrease the spatial separation between the rotational axes 22A, 24A. As such, the axial binding mechanism 20 may be adapted to a variety of applications, e.g., mailpieces using a greater or lesser number of pages to be bound, or using different thickness/type of paper stock. For example, the depth or height of the intermeshing teeth 26 may be varied to deformation bind mailpieces having varying paper thickness. The teeth 26 may be modular or reconfigurable with respect to the supporting rotating elements 22, 24. That is, the teeth 26 may be detachably mounted to the rotating elements 22, 24 so that an array of teeth 26 of greater height may replace an array of lesser height when deformation binding mailpieces having a greater number of pages or employ thicker paper stock.

While the radial support members 28 are shown to include a substantially I-shaped cross-sectional configuration for supporting the axial array of teeth 26, it will be appreciated that other configurations may be employed to structurally support the teeth 26. For example, the radial support members 28 may have a cylindrical cross-section defining a conventional roller for supporting the axial teeth 26 (similar to the schematic representation shown in FIG. 3). Moreover, while a single row of teeth 26 are shown, one associated with each radial support member, it will be appreciated that multiple rows of axial teeth 26 may be employed at various angular positions about the respective rotational axis 22A, 24A. A roller or cylindrically-shaped radial support member 28 may be best suited for this adaptation of the invention.

In the described embodiment, the axial array of teeth 26 is continuous, though it will be appreciated that the array may be continuous or discontinuous. For example, to avoid binding in a particular area of a mailpiece 14, it may be desirable to remove teeth 26 from a particular region or length of the radial support member. The axial array of teeth 26 lie in a common plane, i.e., are coplanar and define an aspect ratio, i.e., length L to width W, of at least two (2) and, preferably at least about five (5). The length L is the dimension along a line parallel to the respective rotational axes 22A, 24A and the width W is the circumferential dimension, i.e., arc length about the respective axes 22A, 24A. Furthermore, while the intermeshing teeth 26 are shown to include a conventional involute profile, i.e., having the shape of a common gear tooth, the teeth 26 may have any of a variety of shapes provided that the teeth 26 protrude radially outboard of the respective rotational axis 22A, 24A, and intermesh with respect to the opposed array of teeth 26. It will generally be desirable to optimize the profile of the teeth 26 based upon specific types and thicknesses of anticipated media material to be deformation bound.

The teeth 26 are driven about their respective axes 22A, 24A, by a drive actuator 20D. In the described embodiment; the shafts 30 are rotationally coupled by a pair of spur gears 34*a*, 34*b* of equal root diameter. The drive actuator 20D may be co-axially aligned with and drive one of the spur gears 34*b*, which, in turn, drives the other spur gear 34a such that both elements 22, 24 counter rotate. Inasmuch as the spur gears 34*a*, 34*b* are equal in root diameter, the rotating elements 22, 24 of the axial binding mechanism 20 rotate at the same rotational speed to index the teeth 26 into meshing engagement. To control the rotational speed, or position the teeth 26 relative to an edge of the sheet material 12, it may be desirable to include a position/home sensor 36 coupled to one of the spur gears 34*a*, 34*b*. An output signal 36S of the position/home sensor 36 may be received by a controller 20C for controlling the rotational speed and/or position of the drive actuator 20D. As such, the controller 20C may index and/or position the teeth 26 with the arrival of the leading or trailing edge of the sheet material 12.

The radial binding mechanism 40 includes two pairs of rotating discs 42, 44 wherein discs 42*a*, 44*a*, rotate about a first axis, 46*a*, and discs 42*b*, 44*b* rotate about a second axis 46*b*. The rotating discs 42, 44 further comprise a plurality of intermeshing teeth 48 projecting radially from one of the parallel axes 46*a*, 46*b* and substantially orthogonal thereto. In the context used herein, "substantially" orthogonal, means that the teeth 48 are oriented at an angle of about in about ±5 degrees relative to the respective rotational axes 46*a*, 46*b*.

The discs 42*a*, 42*b*, 44*a*, 44*b* of each pair are spatially positioned to effect intermeshing engagement of the teeth 48, while leaving a small radial gap to enable the proper deformation or compaction forces to develop between the bound sheet material 12. In the described embodiment, the radial teeth 48 are continuous about the periphery of the discs 42*a*, 42*b*, 44*a*, 44*b*, i.e., fill the periphery, though it will be appreciated that the array of radial teeth 48 may be discontinuous so as to only occupy a segment of the periphery. For example, to avoid deformation binding over a particular length of the mailpiece 14, it may be desirable to form teeth 48 about a portion of the disc circumference, e.g., two-hundred and seventy (270) degrees of the disc circumference, thereby leaving a small portion of the bind line 48 unbound. That is, the portion corresponding to the ninety (90) degree arc absent or void of binding teeth 48. Similar to the axial binding mechanism 20, the teeth 48 may have any of a variety of shapes provided that the teeth 48 project radially outboard of the rotating discs 42, 44 and intermesh to deformation bind the sheet material 12. Finally, each of the pairs 42, 44 may be driven by a drive actuator 40D rotationally coupled to at least one of the discs 42*a*, 44*a* of each pair. Consequently, rotation of one of the discs 42*a*, 44*a*, drives the other disc 42*b*, 44*b* of a respective pair 42, 44 due to the intermeshing relationship of the teeth 48. In the described embodiment, the drive actuator 40D may be electronically connected to a controller 40C to regulate the speed of the drive actuator 40D or to coordinate its operation with the drive actuator 20D of the axial deformation binding mechanism 20.

In operation, the sheet material 12 is drawn through each of the binding mechanisms 20, 40 to deformation bind its edges and, at least partially, enclose any content material between the face sheets of the stacked sheet material 12. More specifically, the rotating elements 22, 24 of the axial binding mechanism 20 deformation bind a leading edge 12$E_L$ of the sheet material 12 along the first bind line 20BL. The motion of the axial binding mechanism 20 feeds the sheet material 12 along a unidirectional path FP to each of the radial binding mechanisms 40. Alternatively, driving rollers (not shown) or other drive devices may transport the sheet material 12 to the radial binding mechanism 40. The radial binding mechanism 40 is disposed at locations corresponding to orthogonal or side edges 12$E_S$ of the sheet material 12. As the discs 42, 44 are rotationally driven, the side edges 12$E_S$ of sheet material 12 are deformation bound. As such, second bind lines 40BL are formed, orthogonal to the first bind line 20BL to, at least partially, enclose the sheet material 12.

Following the radial binding operation, the sheet material 12 may be deformation bound along a trailing edge 12$E_T$, by the axial binding mechanism 20. More specifically, the rotating elements 22, 24 are indexed or synchronously rotate through a three-hundred and sixty (360) degree arc or angle to deformation bind the trailing edge 12$E_T$ of the sheet material 12. Accordingly, the axial binding mechanism 20 can be adapted to produce another bind line 20BL, i.e., one of the first bind lines along a leading edge 12$E_L$ and the other of the first bind lines along a trailing edge 12$E_T$ of the sheet material 12. As such, all edges, i.e., leading, trailing and side edges 12$E_L$, 12$E_S$, 12$E_T$, of the sheet material 12 are deformation bound to form a completed mailpiece 14 (see FIG. 3). Should an embodiment employ teeth 48 which do not fill the circumference of a disc, 42*a*, 42*b*, 44*a*, 44*b*, then an additional pair of gears (not shown) are rotationally coupled to a pair of discs 42*a*, 44*a* or 42*b*, 44*b*, to synchronize the rotation of the disc pair.

Figure 1:
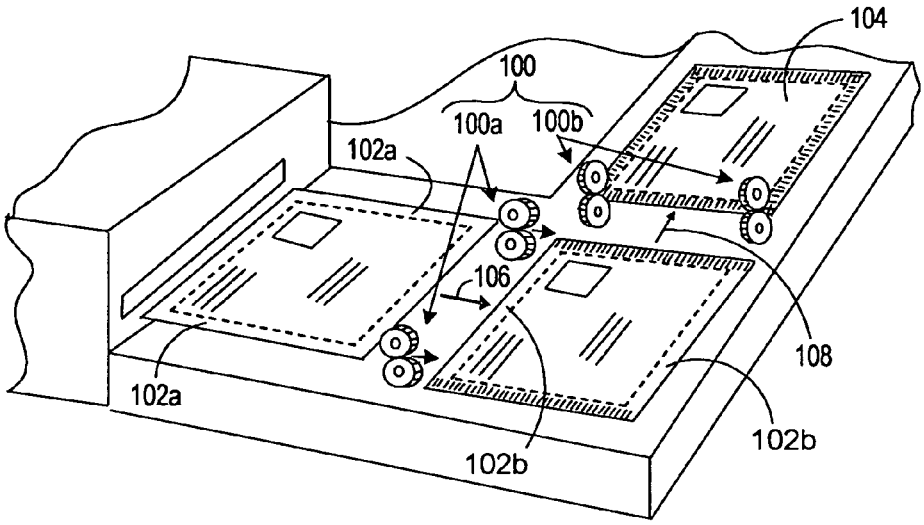
FIG. 1 ( PRIOR ART )
FIG. 1 is a schematic illustration of a prior art deformation binding system which employs pairs of knurling wheels for binding the edges of a flat rectangular mailpiece.
Figure 2A:
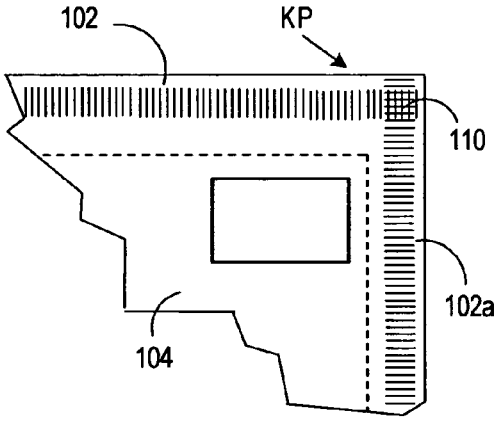
FIG. 2a ( PRIOR ART )
FIG. 2*a* depicts the knurling pattern produced by a prior art deformation binding system, and specifically, the knurling pattern produced in a corner region of a mailpiece.
Figure 2B:
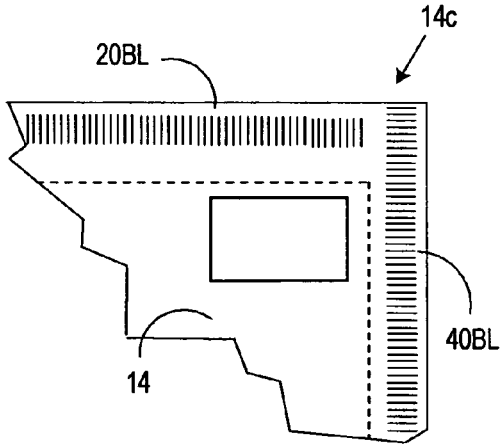
FIG. 2*b* depicts the deformation binding pattern produced by an in-line deformation binding apparatus of the present invention and, specifically, the binding pattern produced in a corner region of a mailpiece.

It should also be appreciated that the deformation binding operations performed by the axial and radial binding mechanisms 20, 40 can be configured to avoid weakness in the corner of the finished mailpiece 14. In FIG. 2*b*, the bind line 20BL formed by the axial binding mechanism 20 may be shortened, i.e., the axial teeth 26 may not span the entire length of the mailpiece 14, so as not to overlap or interfere with the bind line 40BL formed by the radial binding mechanism 40. Alternatively, it may be desirable to omit a segment of teeth 48 on the periphery of the discs 42*a*, 42*b*, 44*a*, 44*b*, of the radial binding mechanism 40 such that when approaching a corner region 14C, the teeth 48 do not intermesh. In this embodiment, the teeth 26 of the axial binding mechanism 20 may span the entire length of the leading and trailing edges 12$E_L$, 12$E_T$, while the radial binding mechanism 40 deformation binds the side edges 12$E_S$ in areas between the corner regions 14C. As such, the structural integrity of the mailpiece 14 is maintained in the corner regions 14C.

These binding operations are also employed and illustrated in another embodiment of the invention shown in FIGS. 5*a*-7, wherein the radial binding mechanism 40 is disposed in advance or forward of the axial binding mechanism 20. In this embodiment, the radial binding mechanism 40 is operative to deformation bind overlapping side edges 12$E_S$ of the sheet material 12. More specifically, in FIGS. 5*a*, 5*b*, and 6, the in-line deformation binding apparatus 10 includes a curved transport baffle 80 (see FIGS. 5*a* and 5*b*) that rolls and overlaps the opposing edges 12$E_S$ of the sheet material 12 to form a substantially tubular-shape (best seen in FIG. 6). The transport baffle 80 may include inner and outer baffle segments 80*a*, 80*b* wherein the outer baffle segment 80*a* includes an enlarged open end for accepting sheet material 12 in a substantially planar orientation. Furthermore, the sheet material 12 is disposed between the baffle segments 80*a*, 80*b* and caused to follow the curved contour of the baffle segments 80*a*, 80*b* which transitions from a substantially planar to a substantially elliptical or tubular shape. More specifically, the outer face 12$_O$ of the sheet material 12 follows the contour of the outer baffle segment 80*a*, while the inner face 12$_I$ of the sheet material is supported by and follows the contour of the inner baffle segment 80*b*. Transport rollers 82 are disposed at a variety of locations about the inner and outer baffle segments 80*a*, 80*b* to cause the sheet material 12 to enter the outer baffle segment 80*a* and follow the inner and outer contours of the baffle segments 80*a*, 80*b*. The transport baffle 80, therefore, rolls at least one planar sheet of material 12 into a tubular sheet 12TS (see FIG. 6) having open ends and a central region wherein the edges overlap 12CS.

In FIGS. 5*a*-7, the tubular sheet 12TS is introduced to a radial binding mechanism 40 similar to that previously described. In this embodiment, however, the discs 42, 44 of the radial binding mechanism 40 are adapted, i.e., rotationally supported, to bind the overlapping side edges 12$E_S$ along the overlapped edges 12CS. More specifically, the radial binding mechanism 40 may include a central mandrel support 90 (best seen in FIG. 7) for rotationally supporting one of the rotating discs 42, while the other rotating disc 44 may be rotationally mounted to an overhead clevis support 92. The drive actuator 40D may drive either of the discs 42, 44, however, in the described embodiment, the drive motor 94 is coupled to the clevis support 82.

The mandrel support 90 (FIG. 7 only) accepts the open end of the tubular shaped sheet 12TS and guides the tubular sheet 12TS to the rotating discs 42, 44. As shown, the mandrel support 90 may be integrated with the inner baffle segment 80*b* of the transport baffle 80. Such integration facilitates the transition from the forming operation, i.e., rolling the planar sheet material 12 into a tubular sheet 12TS, to the deformation binding operation. The rotating discs 42, 44 deformation bind the tubular sheet 12TS along a first bind line 40BL while, at the same time, conveying the bound tubular sheet 12TS along a unidirectional path to the axial binding mechanism 20.

Prior to conveyance to the axial binding mechanism 20, it may be desirable to interpose a folding baffle 95 and/or rolling pins 96 (shown only in FIGS. 5*a* and 5*b*) between the radial and axial binding mechanisms 40, 20. More specifically, to facilitate the axial deformation binding operation, it may be desirable to reconfigure the sheet 12 from a tubular to substantially planar configuration. As such, the folding baffle 95 and/or rolling pins 96 fold the tubular sheet 12TS along oppositely disposed fold lines 12FL to flatten the tubular sheet 12TS in preparation for the axial deformation binding operation.

The axial binding mechanism 20 receives the folded sheet 12TS to deformation binds the open ends thereof along second bind lines 20BL orthogonal to the first bind line 40BL. The axial binding mechanism 20 is the identical mechanism to that described in preceding paragraphs and will not be described in greater detail herein. It is suffice to say that the axial binding mechanism 20 deformation binds the folded sheet material 12 along its leading and trailing edges 12$E_L$, 12$E_T$ to enclose the finished mailpiece 14.

Figure 6:
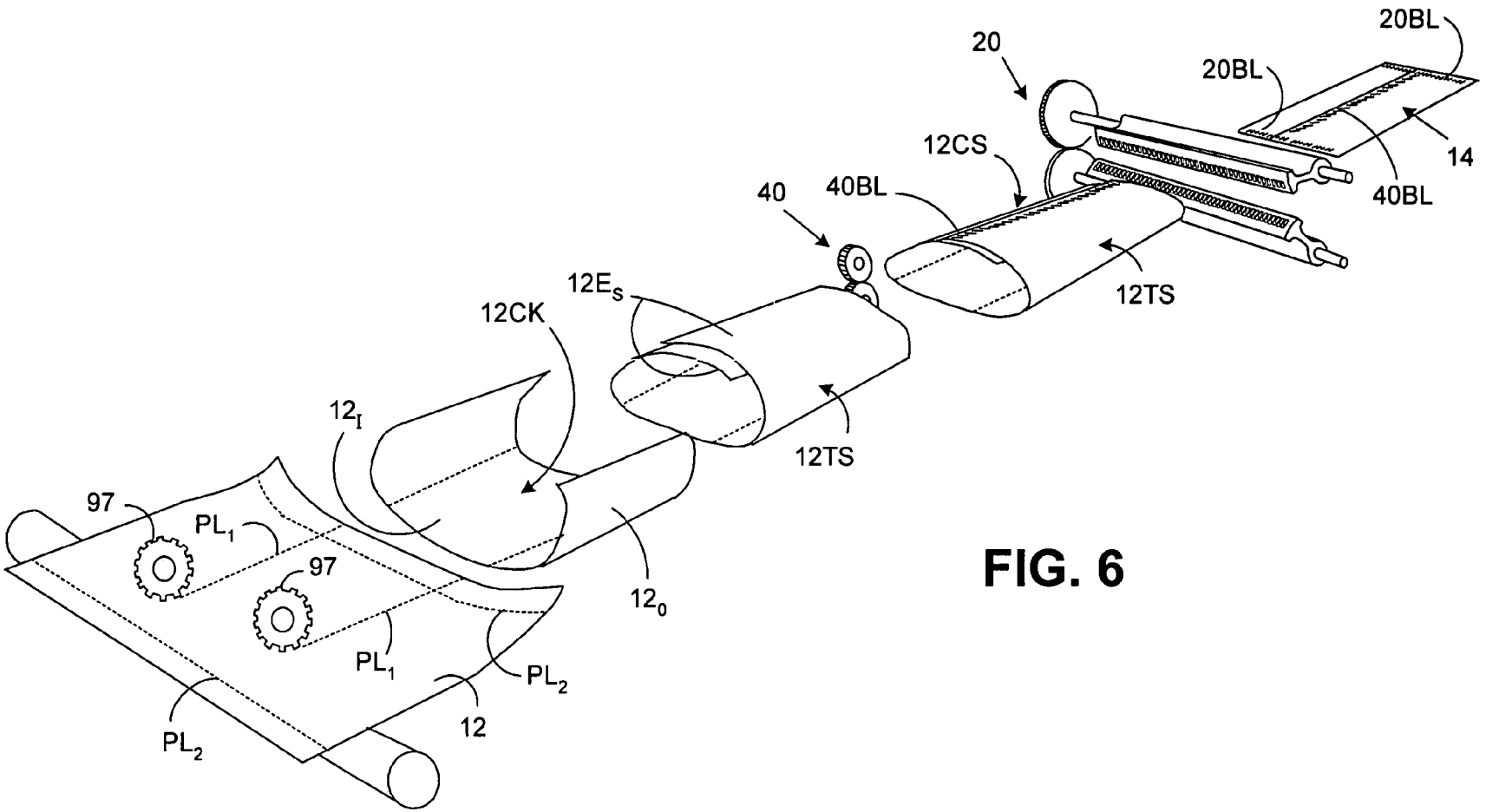
FIG. 6 is a perspective view of various elements depicted in FIGS. 5*a* and 5*b* for illustrating the operation of the transport baffle and the radial and axial deformation binding mechanisms.
Figure 7:
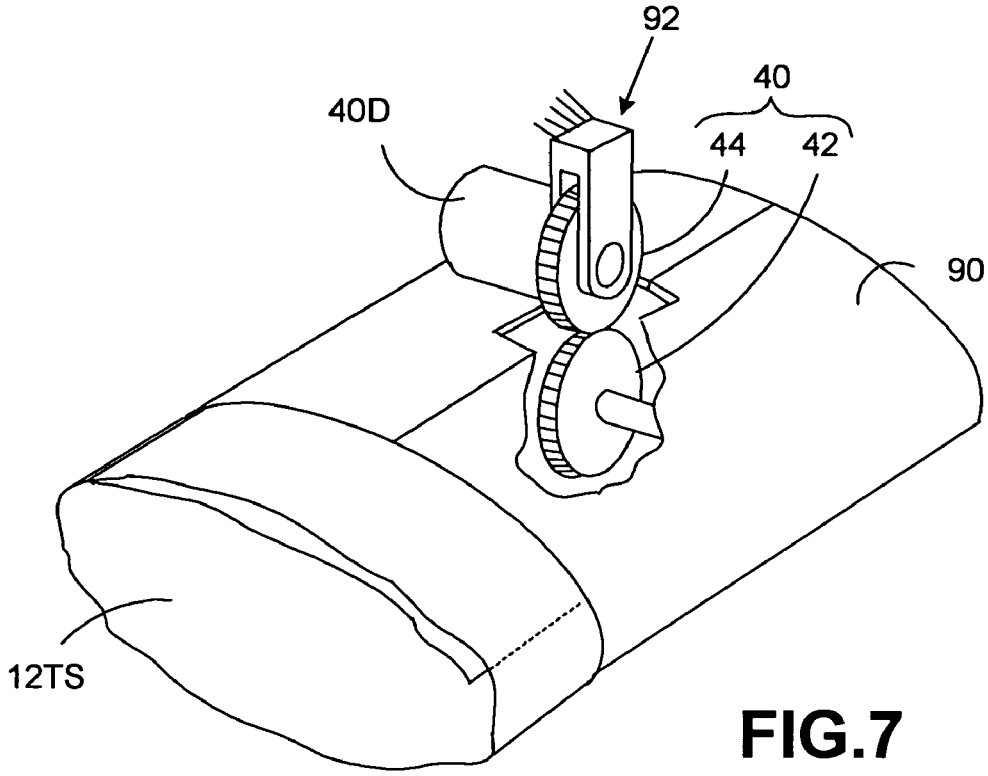
FIG. 7 depicts an isolated perspective view of the radial deformation binding mechanism illustrated in FIGS. 5*a*-6 including a pair of rotating discs wherein one of the discs is rotationally coupled to a mandrel support.
Figure 8:
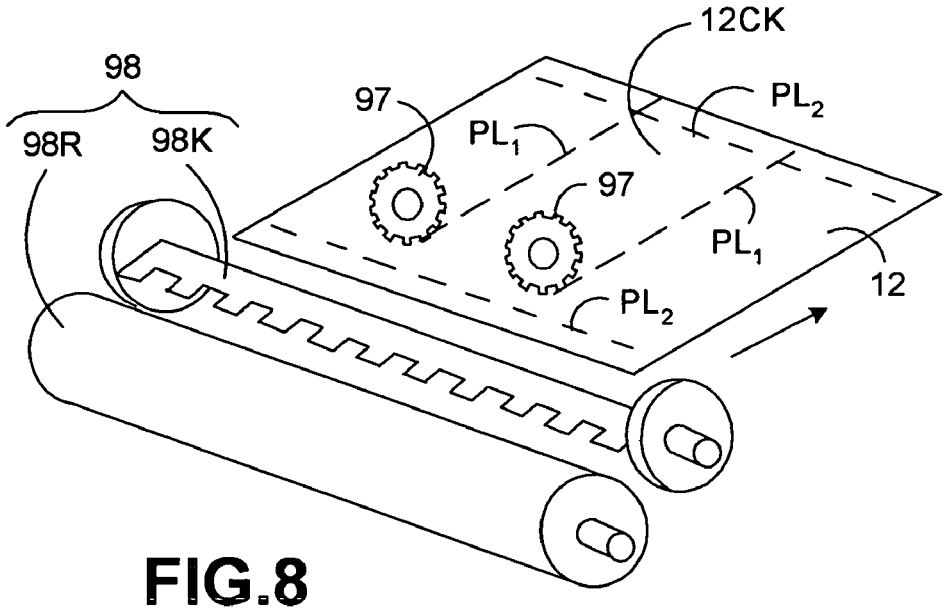
FIG. 8 depicts an alternate embodiment of the in-line deformation binding apparatus including one or more perforation mechanisms to facilitate removal of various portions of the finished mailpiece.

In another embodiment of the invention shown in FIG. 8, the in-line deformation binding apparatus 10 may include one or more mechanisms 97, 98 to perforate the sheet material 12 prior to the radial and axial deformation binding operations. That is, to facilitate folding of the mailpiece 14 or to produce a self-mailer having portions thereof which are removable, it may be desirable to perforate sheet material in advance of the transport baffle 80. For example, one or more perforator wheels 97 may be employed to perforate the sheet material 12 along a first perforation line $PL_1$ substantially parallel to the conveyance path FP of the sheet material 12. In FIGS. 6 and 8, two such lines $PL_1$ can facilitate mailpiece creation by defining the fold lines 12FL (FIG. 6) along which the tubular sheet 12TS is folded to form the finished mailpiece 14. Further, the sheet portion 12CK between the perforation lines PL may represent content material which is conveniently and cleanly detachable such as a check or coupon.

Additionally, the in-line deformation binding apparatus 10 may include an axial perforator 98 to perforate the sheet material 12 along a second perforation line $PL_2$ which is substantially orthogonal to the first perforation line $PL_1$. More specifically, the axial perforator 98 may include a rotating knife 98K disposed axially along and parallel to its rotational axis 99A and an axial roller 98R opposing the knife 98K. Preferably the axial roller 98R is fabricated from a soft deformable material such as urethane rubber to permit the perforating knife 98K to cut the sheet material 12 while providing a soft underlying support. The rotating knife 98K and roller 98R are generally perpendicular to the conveyance path FP, counter rotate and produce a second perforation line $PL_2$ orthogonal to the first perforation line $PL_1$. Two such perforation lines $PL_2$ may be disposed inboard of the anticipated bind lines 20BL (see FIG. 6) produced by the axial binding mechanism 20. Accordingly, the deformation bound portions of the mailpiece, i.e., the portions corresponding to the deformation bind lines 20BL, may be removed and discarded.

In summary, the in-line deformation binding apparatus 10 includes axial and radial binding mechanisms 20, 40 which are juxtaposed to convey sheet material along a unidirectional path. As seen in the embodiments described, sheet material 12 may be deformation bound by both mechanisms independent of the order or sequence of operation. That is, the axial binding mechanism 20 may be disposed forward of the radial binding mechanism 40 or, alternatively, the radial binding mechanism 40 may be disposed in advance of the axial binding mechanism 20. As such, the in-line deformation binding apparatus eliminates the stopping/starting operations or directional changes commonly employed in prior art deformation binding apparatus. Consequently, the in-line deformation binding apparatus can operate at higher speeds, reduces noise and increases reliability.

Furthermore, the axial binding mechanism 20 provides an opportunity to deformation bind entire edges, i.e., without significant travel of the sheet material 12. As a result, the speed of operation may be enhanced. At the same time, portions of the linear array of teeth may be modified, shortened or discontinuous to avoid overlapping with the bind line produced by the radial binding mechanism. Consequently, the structural integrity of the mailpiece may be maintained despite the orthogonal relationship of the bind lines.

Moreover, the in-line deformation binding apparatus enables each bind line to be formed by deformation binding rather than one which may combine various sealing methods, e.g., via gluing/stapling in combination with deformation binding in one direction. As a result, a mailpiece is created without requiring consumable sealing materials. Finally, the in-line deformation binding apparatus eliminates the requirement for specialty forms or prefabricated materials to produce a self-mailer. That is, standard paper stock may be used by the deformation binding apparatus to produce a mailpiece.

It is to be understood that the present invention is not to be considered as limited to the specific embodiments described above and shown in the accompanying drawings, which merely illustrate the best mode presently contemplated for carrying out the invention, and which is susceptible to such changes as may be obvious to one skilled in the art, but rather that the invention is intended to cover all such variations, modifications and equivalents thereof as may be deemed to be within the scope of the claims appended hereto.

What is claimed is:

1. A deformation binding apparatus for fabricating a package having an enclosed area formed therein, comprising:

an axial binding mechanism for deformation binding a sheet material, the axial binding mechanism including first and second rotating elements and a drive actuator for driving at least one of the rotating elements about its rotational axis, each of the first and second rotating elements having a rotational axis and a plurality of teeth, the plurality of teeth being disposed axially and substantially parallel with respect to the rotational axis, the teeth of the first and second rotating elements disposed to intermesh with each other during a portion of the rotation of the first and second rotating elements, and a radial binding mechanism for deformation binding the sheet material, the radial binding mechanism dispensed in-line with the axial binding mechanism along a linear feed path, wherein, at times when the sheet material passes along the linear feed path, the axial binding mechanism and the radial binding mechanism bind the sheet material along first and second bind lines, respectively, which are orthogonal to each other thereby forming the package, wherein the radial binding mechanism includes first and second rotating discs each having a rotational axis and a plurality of teeth, the plurality of teeth being disposed radially with respect to the rotational axis, the teeth of the first and second rotating discs disposed to intermesh with each other, and a drive actuator for driving at least one of the rotating discs, and the deformation binding apparatus further comprising a transport baffle to overlap opposed edges of the sheet material to form a substantially tubular-shape and wherein at least one of the rotating discs of the radial deformation binding mechanism is rotationally coupled to a support mandrel, and open end of the tubular sheet material being accepted by the support mandrel for deformation binding the tubular sheet along the overlapped edges thereby forming the second bind line.

2. The deformation binding apparatus according to claim 1 wherein the first and second rotating elements are substantially parallel and rotationally positioned relative to each other such that the plurality of teeth of the first and second rotating elements intermesh with each other at a predefined angular position.

3. The deformation binding apparatus according to claim 1 wherein the plurality of teeth of each of the first and second rotating elements define an aspect ratio greater than at least two (2).

4. The deformation binding apparatus according to claim 1 wherein the plurality of teeth of the first and second rotating elements are discontinuous.

5. The deformation binding apparatus according to claim 1 wherein each of the first and second rotating elements includes an elongate radial support member for structurally supporting the plurality of teeth.

6. The deformation binding apparatus according to claim 1 wherein the first and second rotating elements rotate through an arc of at least three hundred and sixty (360) degrees, wherein the plurality of teeth of the first and second rotating elements are brought into meshing engagement with each other through a first portion of the arc to form one of the first bind lines, and wherein the plurality of teeth of the first and second rotating elements are brought into meshing engagement through a second portion of the arc to form another of the first bind lines.

7. The deformation binding apparatus according to claim 1 further comprising a controller, coupled to the drive actuator, for controlling a rotational position of the at least one of the first and second rotational elements intermeshing teeth and wherein the teeth are synchronized to deformation bind at least one edge of the package.

8. The deformation binding apparatus according to claim 1 wherein the radial binding mechanism includes a third and fourth rotating disc, the discs operative to form the second bind lines along a first and second edge of the sheet material, the first and second edges being parallel to the linear feed path.

9. The deformation binding apparatus according to claim 1 further comprising at least one perforator wheel for producing a perforation line parallel to the linear feed path of the sheet material, the perforation line facilitating folding of the sheet material and detachment of a portion the package.

10. The deformation binding apparatus according to claim 1 further comprising an axial perforation mechanism for producing a perforation line orthogonal to the linear feed path of the sheet material, the perforation line facilitating detachment of a portion the mailpiece corresponding to one of the bind lines.

11. The deformation binding mechanism according to claim 10 wherein the plurality of teeth of the first and second rotating elements are discontinuous.

12. The deformation binding apparatus according to claim 1 further comprising a position sensor for issuing a position signal indicative of the rotational position of the first and second rotating elements, and a controller, responsive to the position signal, for indexing the intermeshing teeth of the first and second rotating elements with an edge of the sheet material.

* * * * *